US010287117B2

(12) United States Patent
Nishimura

(10) Patent No.: US 10,287,117 B2
(45) Date of Patent: May 14, 2019

(54) IMAGE PROCESSING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Yosuke Nishimura, Nagaizumi Sunto Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/053,875

(22) Filed: Aug. 3, 2018

(65) Prior Publication Data

US 2019/0084783 A1 Mar. 21, 2019

Related U.S. Application Data

(63) Continuation of application No. 15/711,030, filed on Sep. 21, 2017, now Pat. No. 10,065,818.

(51) Int. Cl.

| | |
|---|---|
| ***B65H 1/12*** | (2006.01) |
| ***B65H 1/26*** | (2006.01) |
| ***B65H 3/06*** | (2006.01) |

(52) U.S. Cl.

CPC ..... *B65H 1/266* (2013.01); *B65H 1/12* (2013.01); *B65H 3/0607* (2013.01); (Continued)

(58) Field of Classification Search

CPC .... B65H 1/266; B65H 1/12; B65H 2405/1117
See application file for complete search history.

(56) References Cited

U.S. PATENT DOCUMENTS

| | | | |
|---|---|---|---|
| 5,364,088 | A | 11/1994 | Maruyama et al. |
| 5,697,517 | A | 12/1997 | Holland-Letz |

(Continued)

FOREIGN PATENT DOCUMENTS

| | | |
|---|---|---|
| JP | 06-183576 | 7/1994 |
| JP | 06-321362 | 11/1994 |
| JP | 2000-007168 | 1/2000 |

OTHER PUBLICATIONS

Non-Final Office Action for U.S. Appl. No. 15/711,030 dated Jan. 4, 2018.

*Primary Examiner* — Jeremy R Severson
(74) *Attorney, Agent, or Firm* — Amin, Turocy & Watson LLP

(57) ABSTRACT

In accordance with an embodiment, an image processing apparatus comprises a sheet feed cassette, an operation lever, a sliding section, a sheet lifting and lowering tray, and a main body rail section. The sheet feed cassette is housed to be capable of being pulled out from an apparatus main body. The operation lever is arranged at the side of the sheet feed cassette and is rotatable around a shaft positioned at the middle in a longitudinal direction. The sliding section is arranged at the rear side of the shaft of the operation lever. The sheet lifting and lowering tray can place a sheet and adjust an inclination thereof in conjunction with the operation lever. The main body rail section is arranged in the apparatus main body and guides running of the sliding section at the time of pulling out the sheet feed cassette.

8 Claims, 12 Drawing Sheets

(52) U.S. Cl.
CPC ..... *B65H 2403/41* (2013.01); *B65H 2403/47* (2013.01); *B65H 2405/1117* (2013.01); *B65H 2405/11172* (2013.01)

(56) References Cited

U.S. PATENT DOCUMENTS

| | | | | |
|---|---|---|---|---|
| 6,773,182 | B2 | 8/2004 | Yang | |
| 6,783,126 | B2 | 8/2004 | Amamoto | |
| 7,461,840 | B2 | 12/2008 | Hattori | |
| 8,540,230 | B2 | 9/2013 | Yasuda | |
| 9,815,648 | B2 | 11/2017 | Uchino | |
| 9,919,883 | B2 | 3/2018 | Fuse | |
| 10,065,818 | B1 * | 9/2018 | Nishimura | B65H 1/266 |
| 2006/0157917 | A1 | 7/2006 | Kim et al. | |

* cited by examiner

IMAGE PROCESSING APPARATUS

CROSS-REFERENCE TO RELATED APPLICATION

This application is a Continuation of application Ser. No. 15/711,030 filed on Sep. 21, 2017, the entire contents of which are incorporated herein by reference.

FIELD

Embodiments described herein relate generally to an image processing apparatus.

BACKGROUND

Conventionally, a sheet lifting and lowering mechanism is provided in a sheet feed device of an image forming apparatus (for example, an MFP) of a multi-function peripheral. There is a sheet lifting and lowering mechanism realized by a system control mechanism including a motor and a sensor. In a case in which the sheet lifting and lowering mechanism is constituted by a mechanical structure, a planetary gear and a gear train may be used.

In the case in which there is a sheet feed conveyance path in a cassette pull-out direction, a working part for depressing a sheet lifting and lowering tray is arranged in the cassette pull-out direction. At the time of pulling out a sheet feed cassette from an apparatus main body, a pull-out distance of the sheet feed cassette which is a distance that can be used in depressing the sheet lifting and lowering tray is short and a cassette pull-out load becomes heavy, resulting in deterioration in the operability.

The problem to be solved by the present invention is to provide an image processing apparatus which can sufficiently obtain a distance that can be used in depressing the lifting and lowering tray and can reduce the load at the time of pulling out the cassette even if the working part for depressing the sheet lifting and lowering tray provided in the sheet feed cassette is arranged in the pull-out direction of the sheet feed cassette.

DETAILED DESCRIPTION

In accordance with an embodiment, an image processing apparatus comprises a sheet feed cassette, an operation lever, a sliding section, a sheet lifting and lowering tray, and a main body rail section. The sheet feed cassette is housed to be capable of being pulled out from an apparatus main body. The operation lever is arranged at the side of the sheet feed cassette and is rotatable around a shaft arranged at the middle in a longitudinal direction. The sliding section is arranged at the rear side of the shaft of the operation lever. The sheet lifting and lowering tray can place a sheet and adjust an inclination thereof in conjunction with the operation lever. The main body rail section is arranged in the apparatus main body and guides running of the sliding section at the time of pulling out the sheet feed cassette.

Hereinafter, an image forming apparatus of an embodiment is described with reference to the accompanying drawings.

Figure 1:
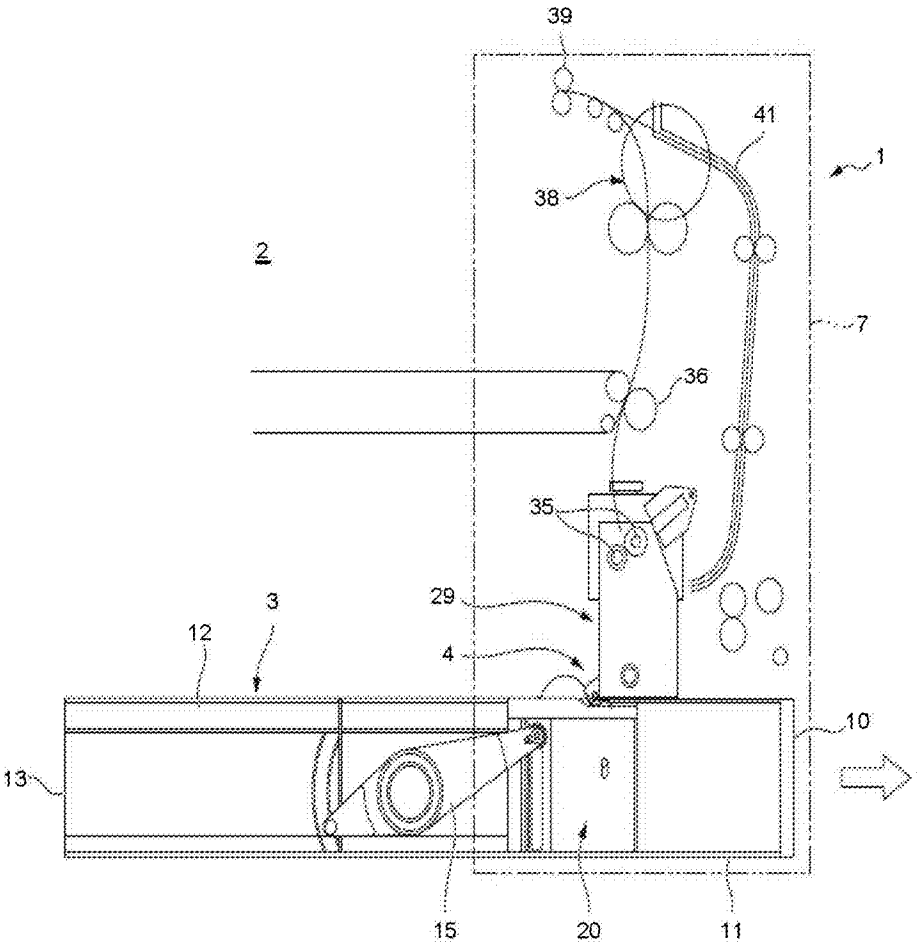
FIG. 1 is a schematic diagram of a sheet feed cassette and a sheet feed conveyance section.

With reference to FIG. 1 to FIG. 12, a sheet feed cassette 3 and a pickup mechanism 4 housed in an apparatus main body 2 in an image forming apparatus 1 which is a multi-function peripheral according to the embodiment is described. FIG. 1 shows the sheet feed cassette 3 which is attached to the apparatus main body 2 of the image forming apparatus 1 of the embodiment to be capable of being pulled out. Herein, a pull-out direction side of the sheet feed cassette 3 that can be inserted into and pulled out from a housing space of the apparatus main body 2 is referred to as a front surface side, and also referred to as a front surface, and a pushing direction side is referred to as the rear side. The sheet feed cassette 3 is capable of placing a sheet layer composed of a plurality of sheets S.

A sheet feed conveyance section 7 is arranged at the upper part near the end in a pull-out direction of the sheet feed cassette 3 attached to the apparatus main body 2. The sheet feed cassette 3 is pulled out in the direction of the front side indicated by an arrow of the image forming apparatus 1. The sheet feed unit 29 is arranged near the sheet feed cassette 3 of the sheet feed conveyance section 7. The sheet feed unit 29 constitutes a part of the sheet feed conveyance section 7. A pickup mechanism 4 is arranged under the sheet feed unit 29.

Figure 2:
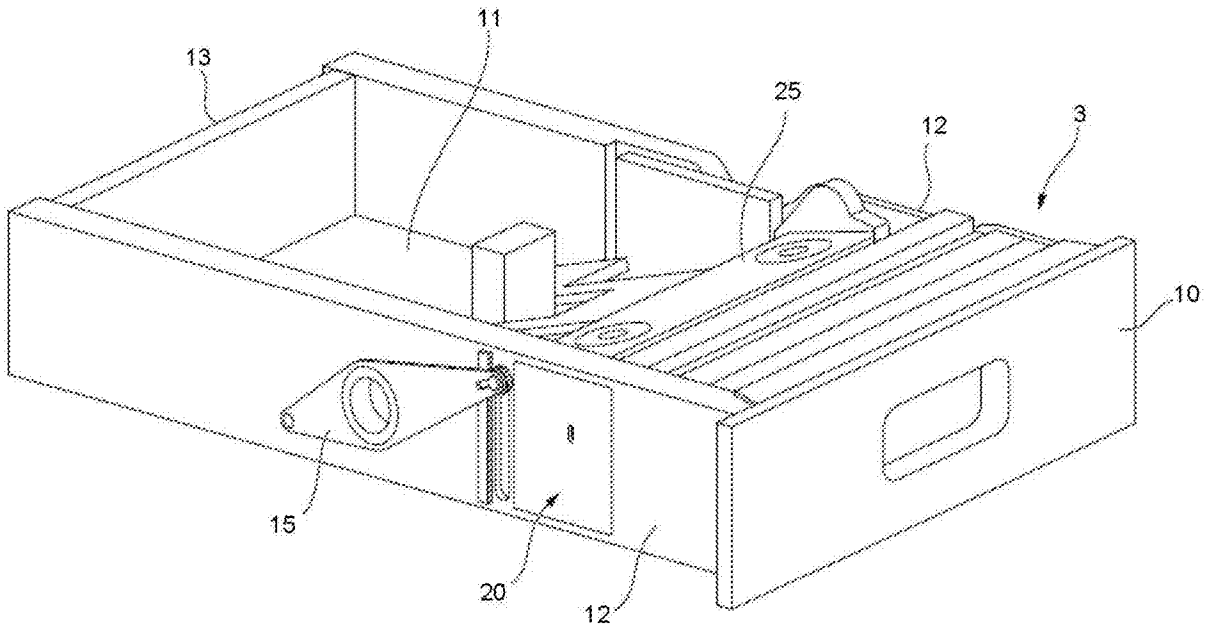
FIG. 2 is a perspective view of the sheet feed cassette.
Figure 3:
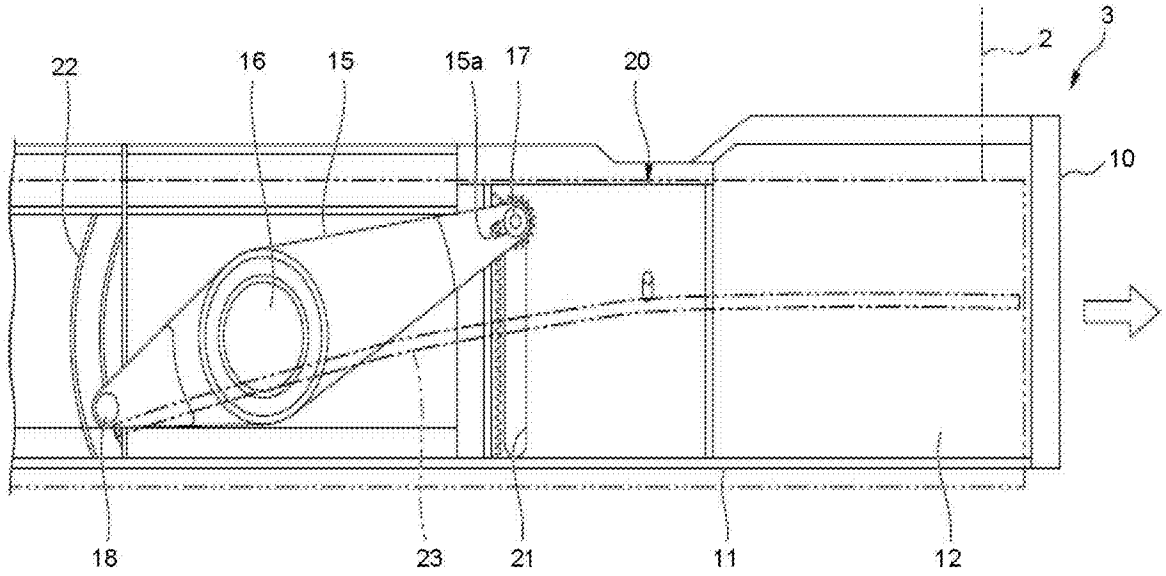
FIG. 3 is a diagram of the sheet feed cassette and a main body rail section.
Figure 4:
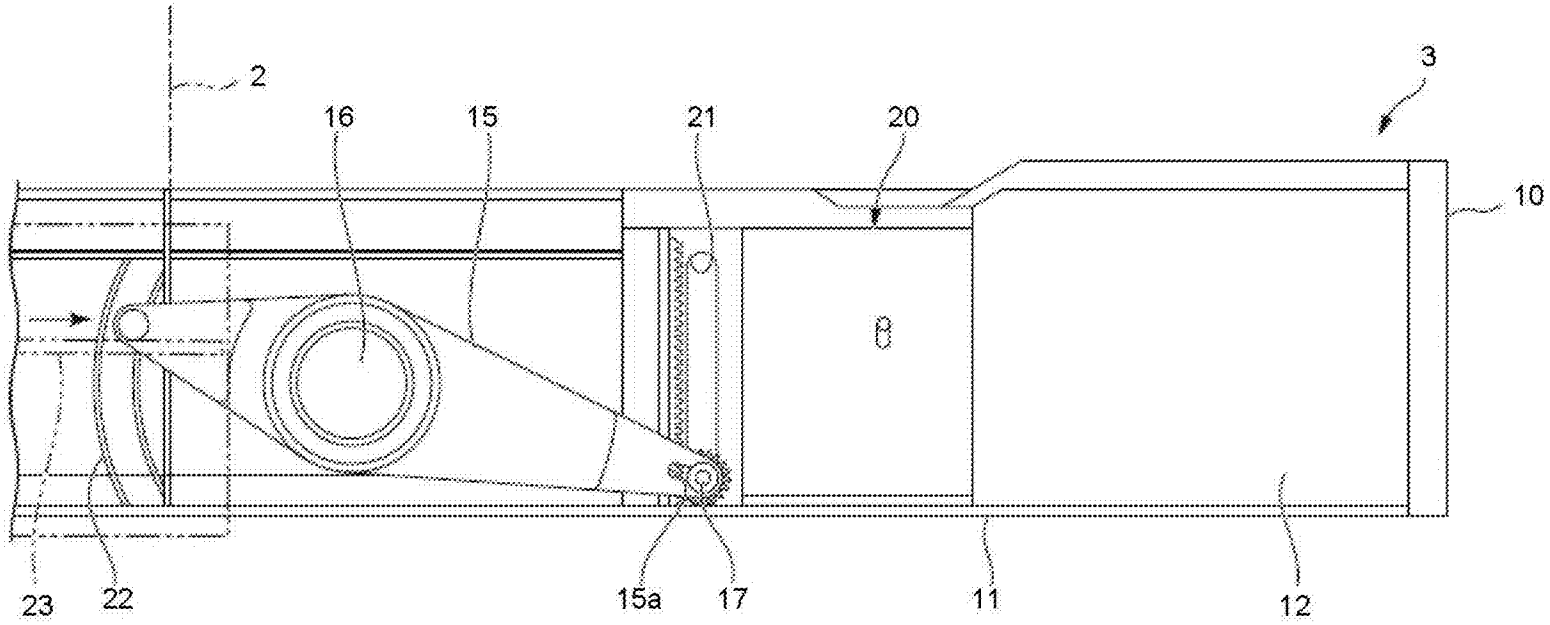
FIG. 4 is a diagram illustrating a state in which the sheet feed cassette is pulled out from the apparatus main body.

FIG. 2 is a diagram illustrating the sheet feed cassette 3 attached to the apparatus main body 2 and the surrounding mechanisms thereof. The sheet feed cassette 3 is formed in a substantially box shape and has a front surface 10, a bottom surface 11, both side surfaces 12 and a back surface 13 provided on the front surface of the apparatus main body 2. In FIG. 3 and FIG. 4, two tray depression levers 15 as operation levers are arranged on both side surfaces 12 of the sheet feed cassette 3 to be capable of swinging around a shaft 16. The tray depression lever 15 extends in a wing shape at both sides of the shaft 16. By providing the tray depression levers 15 at both side surfaces 12, the operation is stabilized. At one end of the front surface 10 side with respect to the shaft 16 of the tray depression lever 15, a connection shaft 17 connected to a sheet lifting and lowering tray 25 described later is provided. The both ends of the connection shaft 17 are connected to the tray depression levers 15 at both sides. At the other end (rear side) of the tray depression lever 15, a sliding section 18 is provided. The sliding section 18 can rotate around its own axis.

Both ends of the connection shaft 17 are inserted through an elongated hole 15*a* formed at the end of the tray depression lever 15. The connection shaft 17 is energized toward a front end side (front surface side) in the elongated hole 15*a* by a spring member (not shown). The connection shaft 17 is inserted in a slide groove 21 formed at the rear side of a detachment mechanism 20 provided at the front surface side of the tray depression lever 15. The slide groove 21 extends linearly in a vertical direction of the side surface 12 of the sheet feed cassette 3. At the time the tray depression lever 15 rotates around the shaft 16 by a predetermined angle, the connection shaft 17 moves forward and backward in the elongated hole 15*a* against the energization force of the spring member. Therefore, the connection shaft 17 can slide vertically in the slide groove 21. An arc-shaped curved rail groove 22 is formed on the side surface 12 of the sheet feed cassette 3 to be vertically curved. The sliding section 18 of the tray depression lever 15 is slidably inserted in the curved rail groove 22. If the tray depression lever 15 rotates around the shaft 16 by the predetermined angle, the sliding section 18 swings in an arc shape along the curved rail groove 22.

On a wall surface of the apparatus main body 2 facing the side surface 12 of the sheet feed cassette 3, a main body rail section 23 is arranged along the longitudinal direction of the side surface 12. The main body rail section 23 is formed in a convex curve shape which gently curves from the rear side of the wall surface of the apparatus main body 2 to the front surface side and is displaced from the lower side to the upper side. As shown in FIG. 4, if the sheet feed cassette 3 is pulled out from the apparatus main body 2, the sliding section 18 of the tray depression lever 15 is displaced from the lower side to the upper side along the main body rail section 23. Therefore, the connection shaft 17 of the tray depression lever 15 moves from the upper side to the lower side along the slide groove 21.

In the present embodiment, if the sheet feed cassette 3 is pulled out from the apparatus main body 2, the rear end is engaged with the apparatus main body 2 and is not detached. The main body rail section 23 guides sliding of the sliding section 18 of the tray depression lever 15 at the time of pulling out the sheet feed cassette 3. A torque limiter 18*a* for suppressing a rotation speed of the sliding section 18 may be arranged in the sliding section 18. At the time of pulling out or pulling back the sheet feed cassette 3, a running speed can be limited by the torque limiter 18*a*. In FIG. 4, the sheet feed cassette 3 is pulled out from the apparatus main body 2. At the time the sheet feed cassette 3 is pulled out, the connection shaft 17 of the sheet depression lever 15 is arranged near the bottom of the sheet feed cassette 3. The sliding section 18 is lifted near the upper surface of the sheet feed cassette 3.

In the embodiment, the main body rail section 23 extends from the front surface of the apparatus main body 2 to the vicinity of the sliding section 18 at the rear side with respect to the shaft 16 of the sheet depression lever 15 (refer to FIG. 3). Preferably, the main body rail section 23 extends from the front surface 10 to the rear side of the shaft 16 or longer. The main body rail section 23 is the longest and has a length equivalent to the length of the side surface 12 of the sheet feed cassette 3. In the main body rail section 23, the longer the length in the pull-out direction of the sheet feed cassette 3 is, the smaller the inclination angle of the curve becomes. Therefore, a force to pull out the sheet feed cassette 3 becomes small. In the example shown in FIG. 3, the main body rail section 23 is inclined in such a manner that the curvature in the vicinity of the sliding section 18 at the rear side is the maximum, and the curvature becomes gradual towards the front surface side. At the time of pulling out the sheet feed cassette 3, due to a change in the curvature angle of the main body rail section 23, the pull-out resistance force changes in such a manner that the force is large at first and gradually becomes small. Therefore, it is possible to prevent the sheet feed cassette 3 from being inadvertently pulled out due to vibration or the like. The sheet feed cassette 3 is suspended on the main body rail section 23 at the sliding section 18 to be supported at the time of pull-out.

Figure 5:
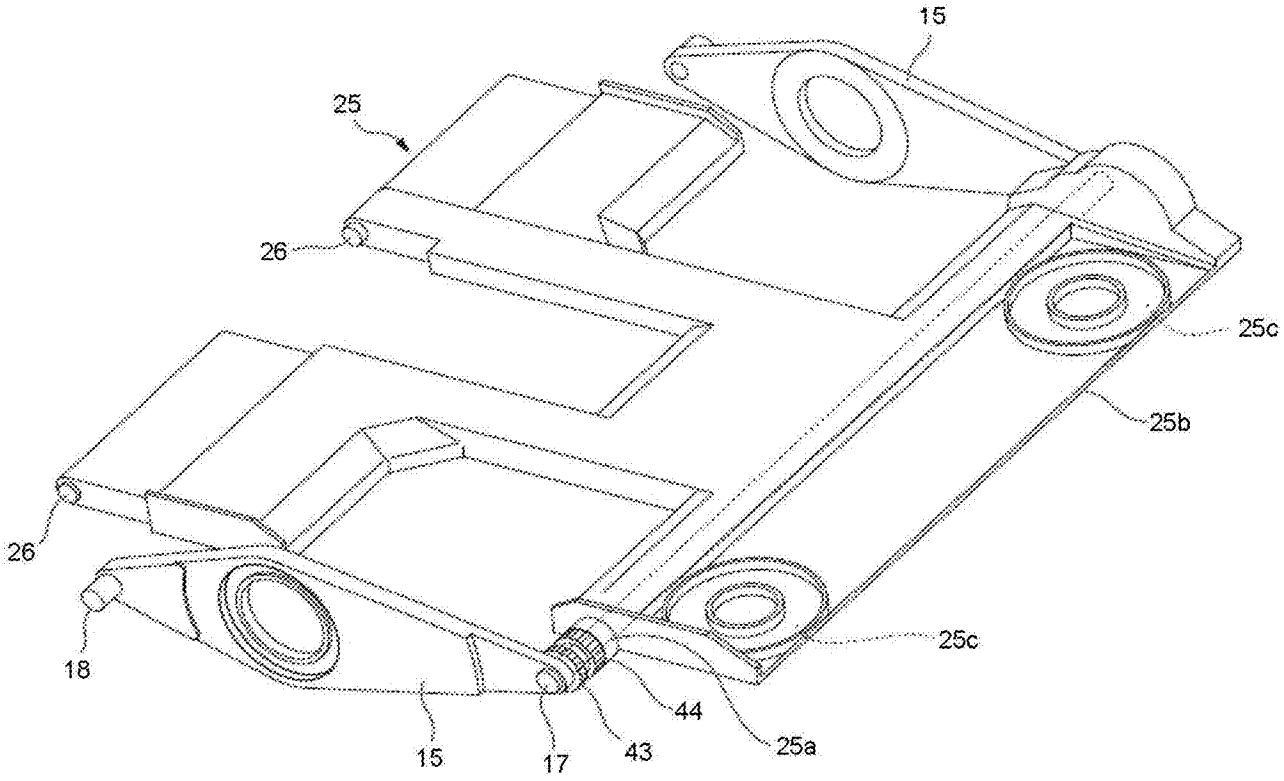
FIG. 5 is a perspective view of a sheet tray and a tray depression lever.
Figure 6:
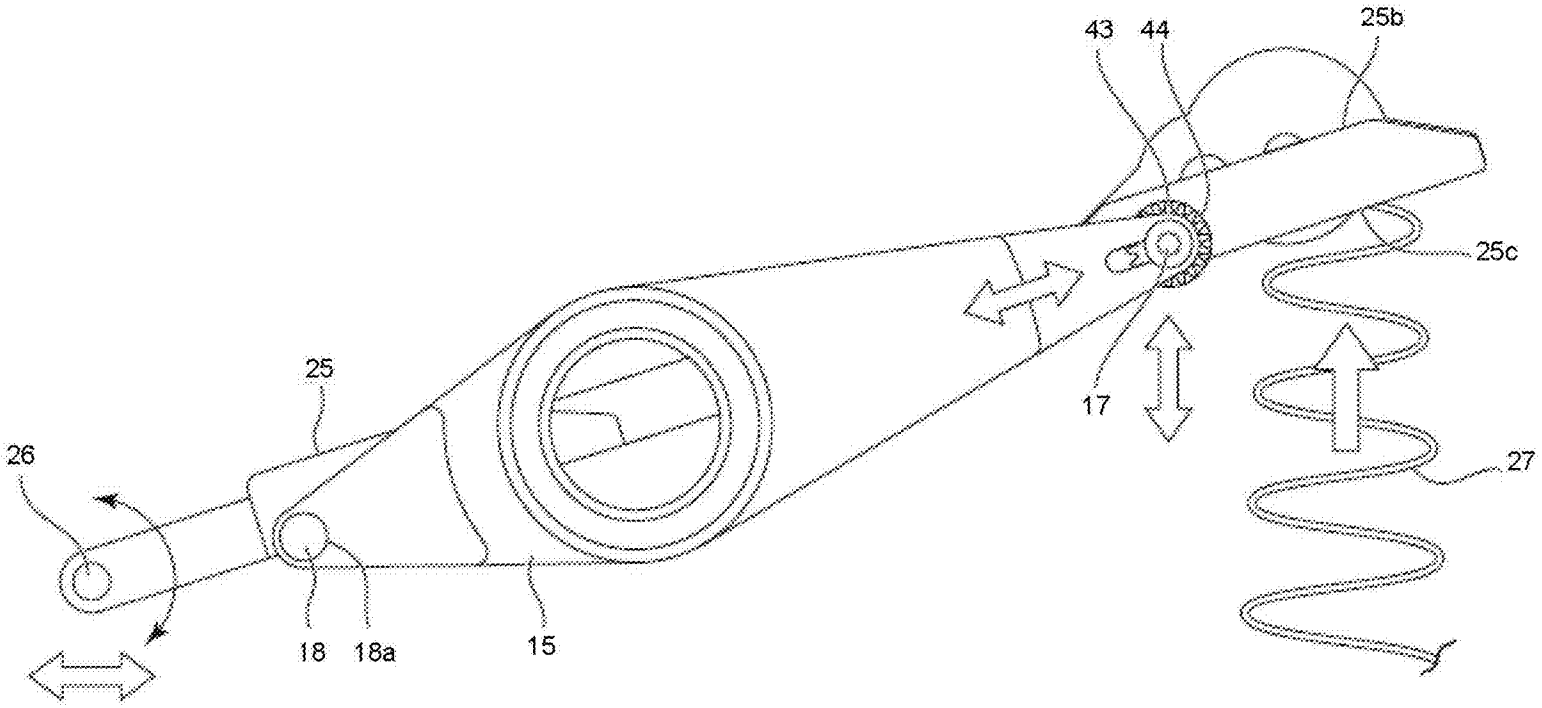
FIG. 6 is a side view of a sheet lifting and lowering tray and the tray depression lever.
Figure 7:
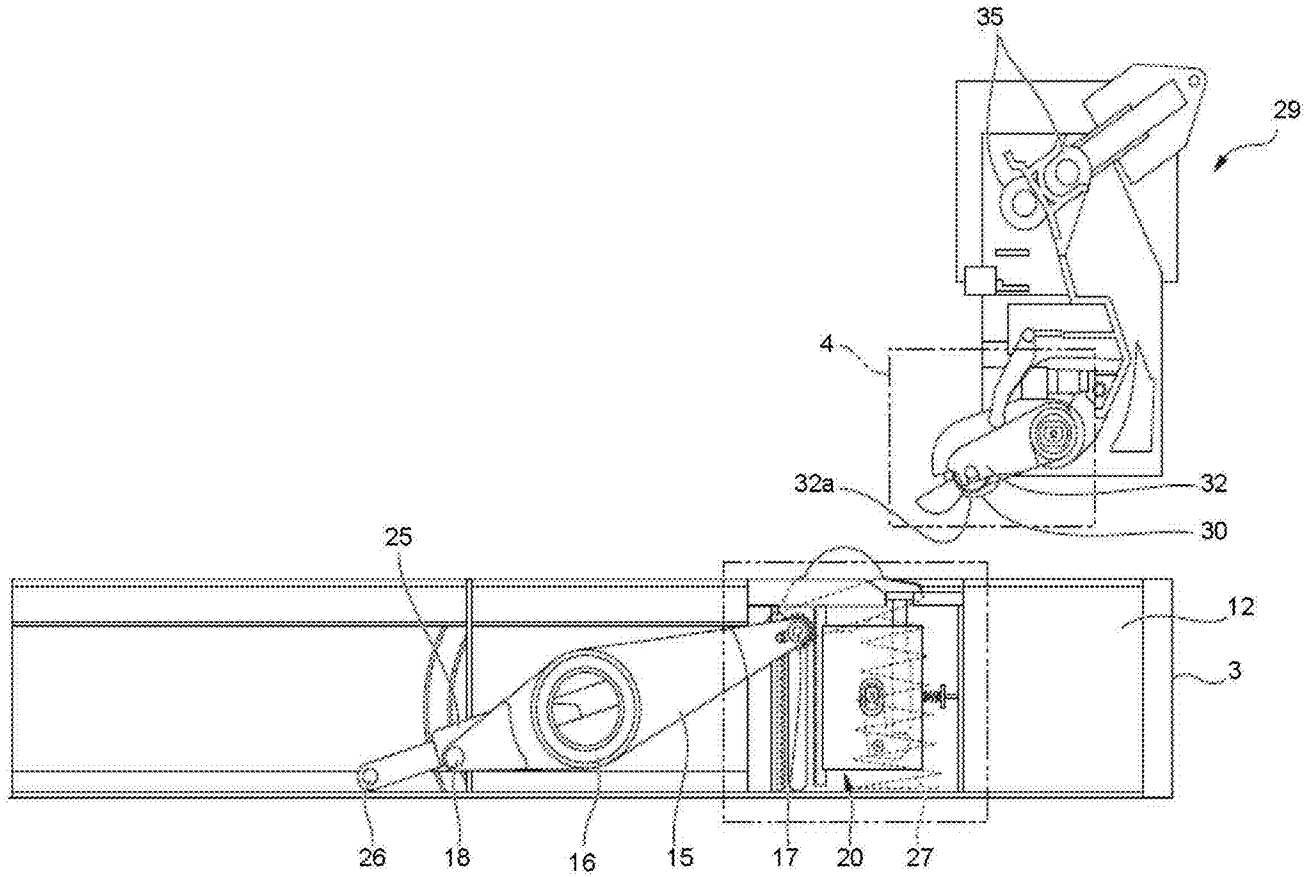
FIG. 7 is a side view separately illustrating the sheet feed cassette and a pickup mechanism.
Figure 8:
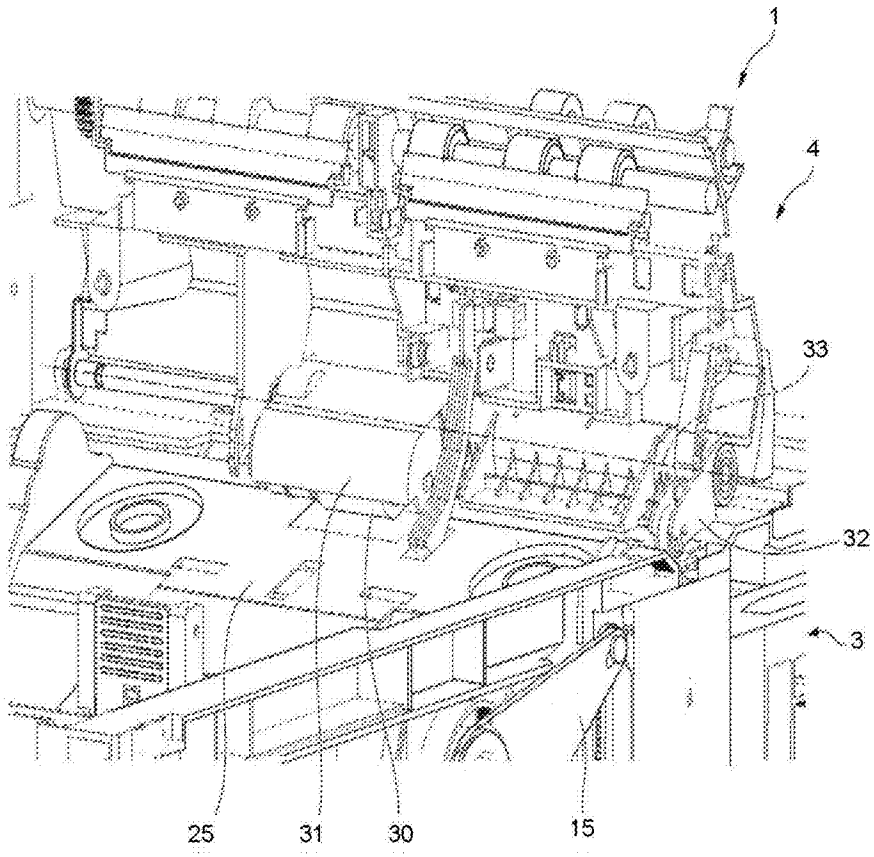
FIG. 8 is a perspective view of the main portions of the sheet lifting and lowering tray and the pickup mechanism.

FIG. 5 and FIG. 6 are diagrams illustrating the tray depression lever 15 and the sheet lifting and lowering tray 25 of the sheet feed cassette 3. The sheet lifting and lowering tray 25 is a plate-like member arranged on the bottom surface 11 of the sheet feed cassette 3. A sheet layer of the sheet S can be placed on the sheet lifting and lowering tray 25. A through hole 25*a* is formed at apart near the front end side of the sheet lifting and lowering tray 25, and the connection shaft 17 of the tray depression lever 15 penetrates through the inside of the through hole 25*a*. In the sheet lifting and lowering tray 25, an extension plate portion 25*b* is integrally formed at the front end side of the through hole 25*a*. A pair of mounting recesses 25*c* is formed on the lower surface of the extension plate portion 25*b*.

A compressed spring member 27 is mounted between the bottom surface 11 of the sheet feed cassette 3 and the mounting recess 25*c*. For example, the spring member 27 is a coil spring. Due to the energization force of the spring member 27, the sheet lifting and lowering tray 25 is inclined by lifting the front end at the front surface side upward. A rotation spindle 26 is arranged as a rotation fulcrum of the sheet lifting and lowering tray 25 at the rear end of the sheet lifting and lowering tray 25. Both ends of the rotation spindle 26 are supported by protrusions (not shown) provided on the bottom surface 11 of the sheet feed cassette 3 to be movable in a left-right direction. The sheet lifting and lowering tray 25 is rotatable around the rotation spindle 26. As shown in FIG. 6, the sheet lifting and lowering tray 25 is energized to be inclined diagonally upward by the spring member 27. The tray depression lever 15 is also inclined in the same direction via the connection shaft 17. The rotation spindle 26 of the sheet lifting and lowering tray 25 is positioned at further rear side from the rear end of the tray depression lever 15 where the sliding section 18 is arranged. In addition, the sheet lifting and lowering tray 25 and the tray depression lever 15 are rotatable with each other in conjunction with the connection shaft 17.

At the time of pulling out the sheet feed cassette 3, the sliding section 18 can be lifted to rotate the tray depression lever 15 around the shaft 16. Due to the rise of the sliding section 18, the sheet lifting and lowering tray 25 can be lowered to the bottom surface 11 against the energization force of the spring member 27. At the position where the sheet lifting and lowering tray 25 descends, the sheet layer of the sheet S can be placed easily.

In FIG. 1 and FIG. 7-FIG. 9, the sheet feed unit 29 of the sheet feed conveyance section 7 is arranged at the upper side of the front surface at the pull-out side of the sheet feed cassette 3. The sheet feed unit 29 has a pickup mechanism 4 in the vicinity of the sheet feed cassette 3. The pickup mechanism 4 has a sheet feed roller 30 and a pusher section 32 that rotate synchronously. The sheet feed roller 30 presses the sheet S at the uppermost side of the sheet layer on the sheet lifting and lowering tray 25 by a spring member (not shown). At the upper half of the sheet feed roller 30, a sheet feed roller case 31 is arranged. At one side of the sheet feed roller 30, the pusher section 32 is arranged at a position by a predetermined distance. The pusher section 32 presses a detachment slider 54 (described later) provided in the detachment mechanism 20 (refer to FIG. 10). A rotatable pusher roller 32*a* is arranged in the pusher section 32. The pusher section 32 can also press the detachment slider 54 with a spring member (not shown). The sheet feed roller 30 and the pusher section 32 are rotatably supported by a sheet feed roller connection shaft 33. The sheet feed roller 30 and the pusher section 32 are rotatable synchronously around the sheet feed roller connection shaft 33. If the sheet feed roller 30 contacts with the uppermost sheet S placed on the sheet lifting and lowering tray 25, the pusher section 32 can also press the detachment slider 54 in synchronization.

In the sheet feed conveyance section 7, the sheet feed unit 29 delivers the sheet S at the uppermost side of the sheet layer which is picked up one by one by the sheet feed roller 30 to the conveyance roller 35. On a main conveyance path from the conveyance roller 35 to the secondary transfer roller 36, other conveyance rollers and resist rollers are provided. The resist roller aligns the position of the front ends of the sheets S conveyed by the conveyance roller 35. The resist roller conveys the sheet S to enable the front end of a transfer region of a toner image on the sheet S to reach a secondary transfer roller 36. The transfer region of the toner image is a region excluding a formation region of the end blank part in the sheet S.

A fixing device 38 is arranged at the downstream side (upper side in the figure) of the secondary transfer roller 36 in a conveyance direction of the sheet S. At the downstream side of the fixing device 38, a conveyance roller 39 is arranged. The conveyance roller 39 discharges the sheet S to a sheet discharge section. At the downstream side of the fixing device 38 in the conveyance direction of the sheet S, an inversion conveyance path 41 is arranged. The inversion conveyance path 41 reverses the sheet S to guide it to the upstream side of the resist roller. The inversion conveyance path 41 is used at the time of performing a duplex printing.

In FIG. 5 and FIG. 6, one-way clutches 44 each having a ratchet-structured gear 43 are arranged between both ends of the connection shaft 17 provided in the tray depression lever and the sheet lifting and lowering tray 25. The ratchet-structured gear 43 is meshed with a later-described ratchet tooth 57 of the detachment mechanism 20. The one-way clutch 44 is an idle mechanism.

Figure 9:
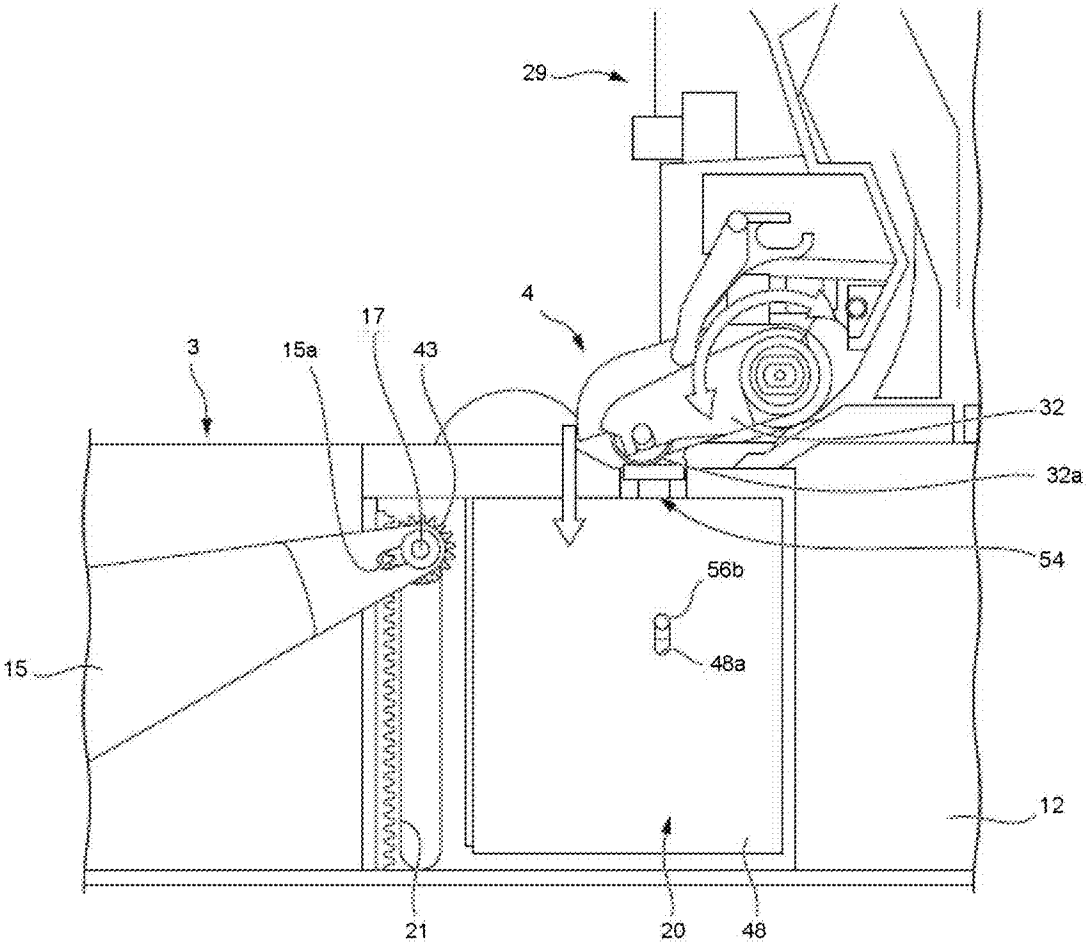
FIG. 9 is a schematic diagram of a pusher section of the pickup mechanism and a detachment mechanism.
Figure 10:
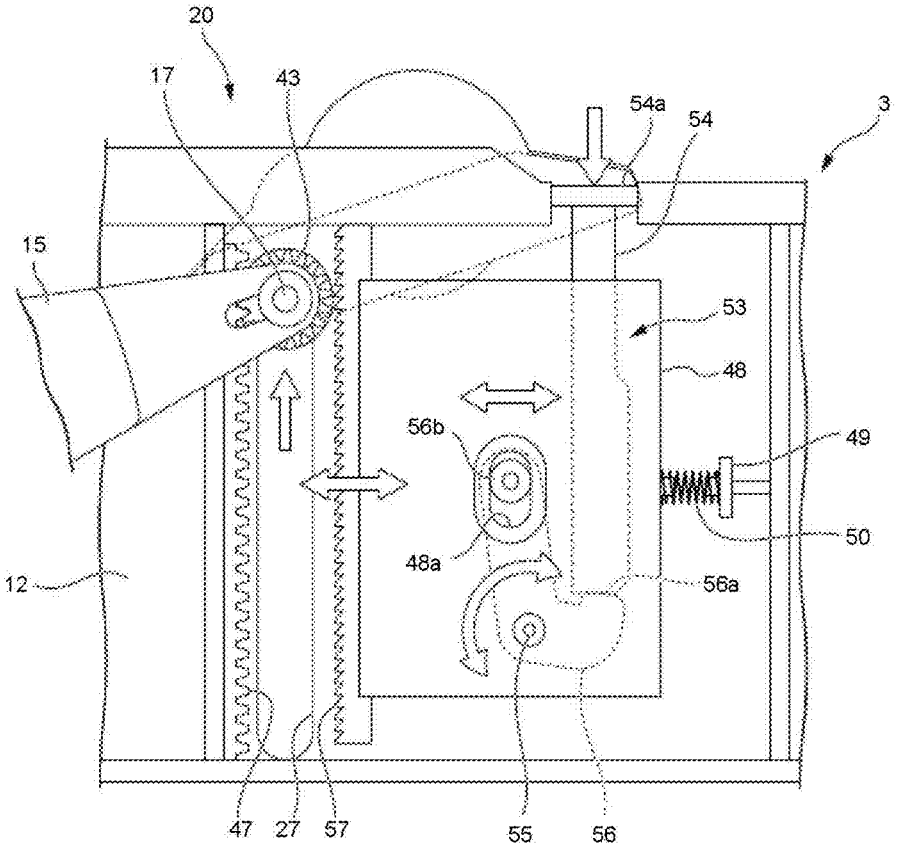
FIG. 10 is an enlarged view of the detachment mechanism.
Figure 11:
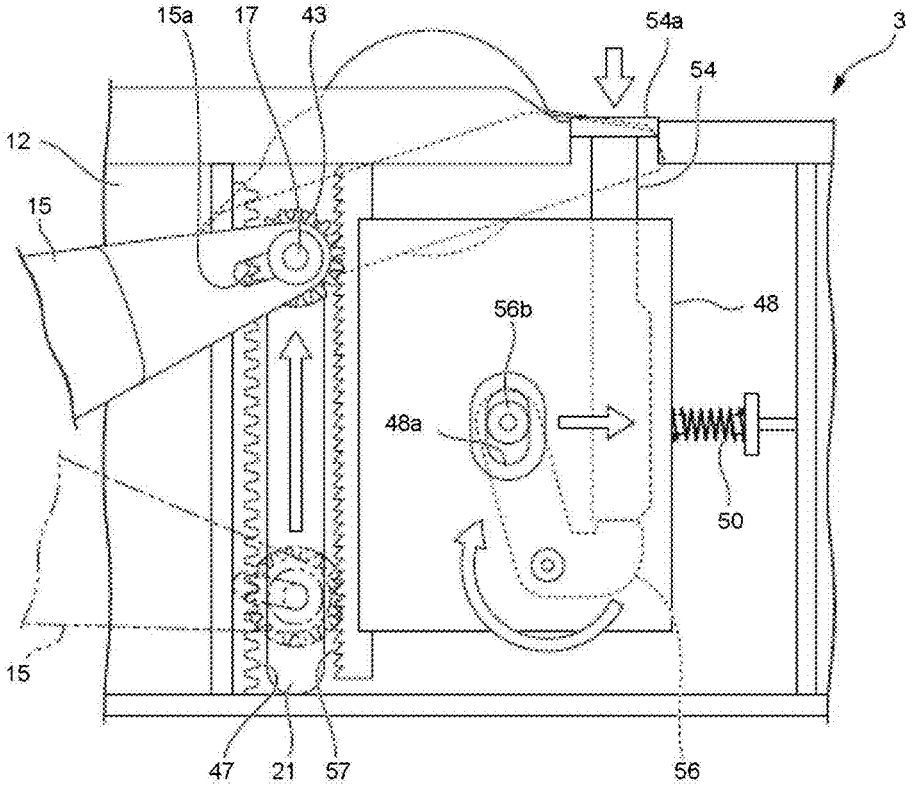
FIG. 11 is a schematic diagram of the operations of the detachment mechanism and an operation lever.

With reference to FIG. 9-FIG. 11, the detachment mechanism 20 provided at the front surface side of the sheet feed cassette 3 is described. The detachment mechanism 20 regulates a lifting and lowering movement of the sheet lifting and lowering tray 25.

On the side surface 12 of the sheet feed cassette 3, the slide groove 21 extending in the vertical direction is formed at the front surface side of the tray depression lever 15. The connection shaft 17 provided at the front end of the tray depression lever 15 moves vertically in the slide groove 21. A guide rack 47 is formed at one side of the slide groove 21. The guide rack 47 has a plurality of teeth continuously formed in the vertical direction. The ratchet-structured gear 43 of the connection shaft 17 is meshed with the guide rack 47 to be movable vertically.

At the other side of the slide groove 21, a detachment ratchet section 48 movable in a horizontal direction provided in the detachment mechanism 20 is arranged. For example, the detachment ratchet section 48 is box-shaped. A supporting member 49 is formed at the front surface side of the side surface 12. An elastic spring 50 for applying an energization force for pushing the detachment ratchet section 48 to the rear side is attached to the supporting member 49. For example, the elastic spring 50 is a spring member such as a coil spring.

A link mechanism 53 is arranged at the inner side of the detachment ratchet section 48. The link mechanism 53 includes a detachment slider 54 and a detachment link 56 rotatable around a spindle 55. The detachment slider 54 extends vertically to be movable vertically. A receiving section 54*a* of the detachment slider 54 is pressed by the pusher roller 32*a* of the pusher section 32 to move downward. For example, the detachment link 56 is substantially L-shaped. The detachment link 56 is pressed by the detachment slider 54 at an abutting section 56*a* provided on one portion of the detachment link 56. A boss-like working part 56*b* provided on the other portion of the detachment link 56 is fitted into an elongated hole 48*a* formed in the detachment ratchet section 48. At an end at the slide groove 21 side of the detachment ratchet section 48, ratchet teeth 57 are formed. In the ratchet teeth 57, a plurality of teeth is continuously formed in the vertical direction to face the guide rack 47. The ratchet teeth 57 can mesh with the ratchet-structured gear 43.

In the detachment mechanism 20, in a state in which the detachment slider 54 is not pressed by the pusher section 32, the ratchet teeth 57 are meshed with the ratchet-structured gear 43. In a state in which the ratchet-structured gear 43 is meshed with the ratchet teeth 57 of the detachment ratchet section 48, further rise of the sheet lifting and lowering tray 25 is prevented (refer to FIG. 11).

If the receiving section 54*a* of the detachment slider 54 is pressed by the pusher section 32, the detachment link 56 rotates around the spindle 55. The working part 56*b* of the detachment link 56 presses the elongated hole 48*a* to move the detachment ratchet section 48 in a direction away from the slide groove 21. Therefore, the ratchet-structured gear 43 is separated from the ratchet teeth 57. In a state in which the ratchet-structured gear 43 is separated from the ratchet teeth 57 of the detachment slider 54, the sheet lifting and lowering tray 25 is raised by the energization force of the spring member 27 (refer to FIG. 11).

As shown in FIG. 11, the connection shaft 17 of the sheet depression lever 15 rises from the lower end of the slide groove 21 by the energization force of the spring member 27. At that time, the ratchet-structured gear 43 is not meshed with the ratchet teeth 57. As the sheet feed roller 30 is pressed against the sheet layer at the upper end and the pusher section 32 escapes from the detachment slider 54, the ratchet-structured gear 43 is meshed with the ratchet teeth 57. If the connection shaft 17 of the sheet depression lever 15 lowers the slide groove 21, the ratchet-structured gear 43 is meshed with the ratchet teeth 57. At this time, the ratchet teeth 57 idle with the one-way clutch 44.

Figure 12:
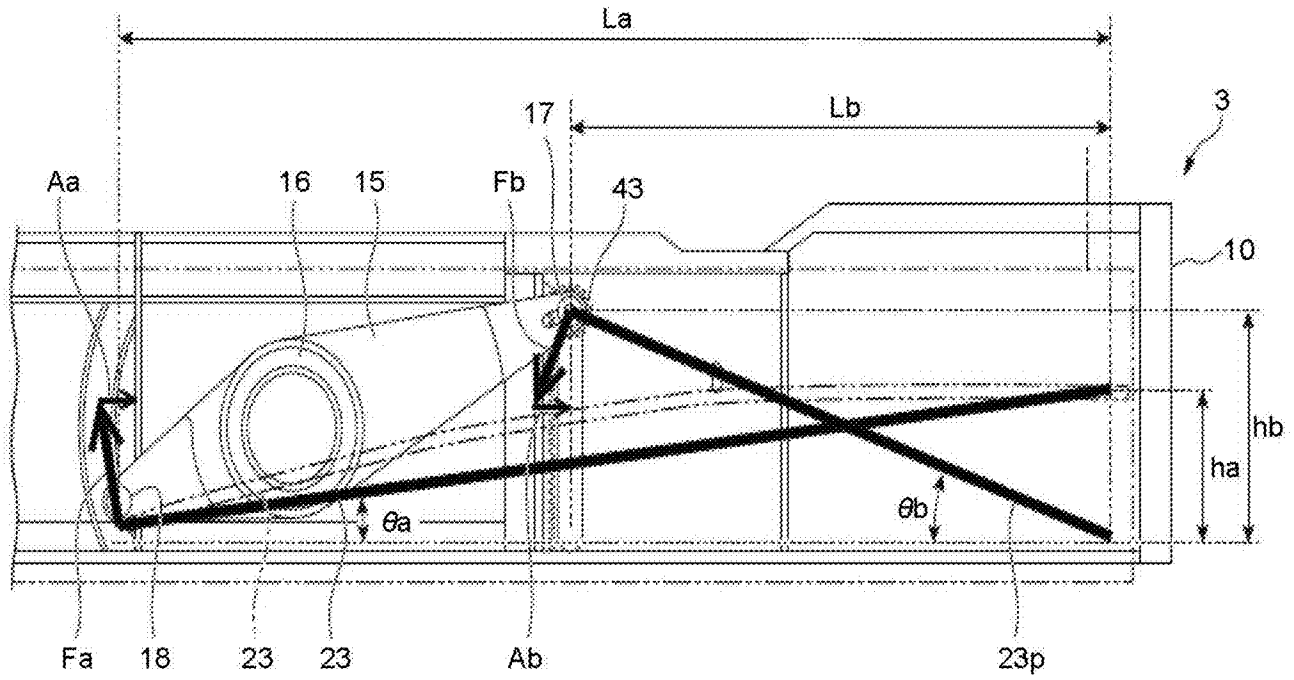
FIG. 12 is a schematic diagram of a positional relationship between the tray depression lever and the main body rail section.

Next, with reference to FIG. 12, an example of the relationship between the length of the main body rail section 23 of the embodiment and a rail portion 23*p* of the conventional embodiment and a pull-out force is described. The main body rail section 23 of the embodiment has a length from the front surface of the sheet feed cassette 3 to the vicinity of the sliding section 18 of the sheet depression lever 15. The rail portion 23*p* of the conventional embodiment has a length from the front surface 10 to the connection shaft 17. The main body rail section 23 of the embodiment is assumed to have a length La, a height ha, a rail angle θa, a component force Aa and a reaction force Fa at the time of pull-out. The rail portion 23*p* of the conventional embodiment is assumed to have a length Lb, a height hb, a rail angle θb, a component force Ab, and a reaction force Fb at the time of pull-out. However, La>Lb and ha<hb.

The component force Aa at the time of pulling out the main body rail section 23 of the embodiment is as follows.

Rail angle: $\theta a = \tan-1(ha/La)$[rad]

Component force in pull-out: $Aa = Fa * \sin \theta a$

The component force Ab at the time of pulling out the rail portion 23*p* of the conventional embodiment is as follows.

Rail angle: $\theta b = \tan-1(hb/Lb)$[rad]

Component force in pull-out: $Ab = Fa * \sin \theta b$

The smaller the rail angle θa (<θb) of the main body rail section 23 is, the smaller the component force in the cassette pull-out direction generated by the energization force of the sheet lifting and lowering tray 25 becomes. The component force Aa at the pull-out of the embodiment is smaller than the component force Ab at the pull-out in the conventional embodiment (Aa<Ab). The pull-out force of the sheet feed cassette 3 is smaller than that in the conventional embodiment. Therefore, the longer the main body rail section 23 is in the pull-out direction, the smaller the rail angle θa becomes, and the smaller the pull-out force of the sheet feed cassette 3 becomes.

The image forming apparatus 1 including the sheet feed cassette 3 and the pickup mechanism 4 according to the present embodiment has the above-described constitution. Next, the operation of the image forming apparatus 1 of the embodiment is described.

The sheet feed cassette 3 is housed in the apparatus main body 2 with the sheet layer placed on the sheet lifting and lowering tray 25 therein. The sheet lifting and lowering tray 25 is in an inclined state held upward by the energization force of the spring member 27. Since the tray depression lever 15 is linked to the sheet lifting and lowering tray 25 via the connection shaft 17, the front surface side is inclined upward (refer to FIGS. 3 and 6). At this position, the ratchet-structured gear 43 provided on the connection shaft 17 is meshed with the ratchet teeth 57 of the detachment mechanism 20. In this way, further rise of the sheet lifting and lowering tray 25 is prevented.

The sheet S at the uppermost side of the sheet layer is pressed against the sheet feed roller 30 of the pickup mechanism 4. At this position, the pusher section 32 synchronized with the sheet feed roller 30 is separated from the detachment slider 54 at the sheet feed cassette 3 side (refer to FIG. 11).

From this state, the uppermost sheets S are picked up one by one by the rotation of the sheet feed roller 30 to be conveyed to the sheet feed unit 29. The sheet feed roller 30 floats corresponding to the thickness of the sheet S pulled out. If a predetermined amount of the sheets S placed on the sheet feed cassette 3 decreases, the sheet feed roller 30 descends in conjunction with the change of the uppermost surface. The thickness of the sheet S by which the sheet feed roller 30 descends can be arbitrarily set. The pusher section 32 also descends in synchronization with the sheet feed roller 30.

If the pusher section 32 descends by a preset predetermined distance according to the amount of decrease of the sheets S and the amount of descent of the sheet feed roller 30, the detachment slider 54 of the detachment mechanism 20 is pushed. Then, the contact portion 56*a* of the detachment link 56 is pushed to rotate around the spindle 55. The working part 56*b* of the detachment link 56 presses the elongated hole 48*a* to move the detachment ratchet section 48 toward the front surface side against the energization force of the elastic spring 50. Thus, the ratchet teeth 57 of the detachment ratchet section 48 is disengaged from the ratchet-structured gear 43 provided in the connection shaft 17 of the sheet lifting and lowering tray 25 (refer to FIG. 10).

Then, the sheet lifting and lowering tray 25 rises by the energization force of the spring member 27 and collides with the sheet feed roller 30, thereby pushing up the sheet feed roller 30 to stop it. The pusher section 32 also rises synchronously with the sheet feed roller 30 to move away from the detachment slider 54. Then, in the detachment mechanism 20, the detachment ratchet section 48 moves to the slide groove 21 side by the energization force of the elastic spring 50. The ratchet teeth 57 of the detachment ratchet section 48 are meshed with the ratchet-structured gear 43 to stop the sheet lifting and lowering tray 25. By being pushed by the elongated hole 48*a* of the detachment ratchet section 48, the detachment link 56 and the detachment slider 54 return to their original positions.

In this way, the sheet lifting and lowering tray 25 can be raised according to the thickness of the sheets S set in the sheet lifting and lowering tray 25 in the sheet feed cassette 3. The uppermost surface of the sheet layer placed on the sheet lifting and lowering tray 25 can be held at a constant height every time a predetermined amount of the sheets S is decreased. The feeding operation of the sheet S by the sheet feed roller 30 is stably performed.

Next, an operation of pulling out the sheet feed cassette 3 from the apparatus main body 2 is described mainly with reference to FIG. 3 and FIG. 4.

In FIG. 3, if the sheet S in the sheet feed cassette 3 is consumed, the sheet lifting and lowering tray 25 contacts with the sheet feed roller 30 in a state of being inclined at a constant height. In the tray depression lever 15, the connection shaft 17 is also held near the upper end of the slide groove 21, and the front surface side thereof is held inclined upward. The ratchet-structured gear 43 provided on the connection shaft 17 is meshed with the ratchet teeth 57 of the detachment mechanism 20. The sliding section 18 of the tray depression lever 15 is arranged near the lower end at the rear side of the main body rail section 23.

In this state, the sheet feed cassette 3 is pulled outward from the apparatus main body 2. The sliding section 18 at the inner side of the tray depression lever 15 rises gradually along the convex curve of the main body rail section 23. At the same time, the sliding section 18 rotates around the shaft 16 along a curved rail groove 22 formed on the side surface 12 of the sheet feed cassette 3. Correspondingly, the tray depression lever 15 rotates around the shaft 16. The connection shaft 17 at the front surface side of the tray depression lever 15 descends along the slide groove 21. The ratchet-structured gear 43 provided on the connection shaft 17 is meshed with the ratchet teeth 57 of the detachment mechanism 20 to descend. Moreover, the ratchet-structured gear 43 idles with the one-way clutch 44. Depending on the curved shape of the main body rail section 23, the pull-out resistance force of the sheet feed cassette 3 is relatively large at the beginning of pull-out, but then decreases.

In response to the pull-out of the sheet feed cassette 3, the tray depression lever 15 rotates around the shaft 16. As shown in FIG. 4, the sliding section 18 of the tray depression lever 15 moves along the main body rail section 23 to rise. The height of the connection shaft 17 of the tray depression lever 15 gradually becomes lower. The connection shaft 17 linearly descends along the slide groove 21 while retracting the elongated hole 15*a* formed in the tray depression lever 15. The sheet lifting and lowering tray 25 connected by the connection shaft 17 rotates downward around the rotation spindle 26 at the rear side. The main body rail section 23 which guides the running of the sliding section 18 extends from the front surface side to the vicinity of the sliding section 18 and has a gentle inclination. Therefore, at the time of pulling out the sheet feed cassette 3, the pull-out resistance force of the sheet feed cassette 3 is small.

The sheet feed cassette 3 stops at a position where the back surface 13 is pulled out to the vicinity of the front surface of the apparatus main body 2. At the stop position, the sliding section 18 of the tray depression lever 15 is positioned above and the connection shaft 17 is positioned at the lower end. Since the sheet lifting and lowering tray 25 falls down to the bottom surface 11 side of the sheet feed cassette 3, the sheet layer can be placed. Due to the descent of the sheet feed roller 30 and the pusher section 32, the ratchet teeth 57 provided in the detachment ratchet section 48 of the detachment mechanism 20 are not meshed with the ratchet-structured gear 43.

After placing the sheet layer, the sheet feed cassette 3 is housed in the apparatus main body 2. The sheet lifting and lowering tray 25 and the tray depression lever 15 are pushed by the opposite operation to that at the time of pull-out. The sliding section 18 of the tray depression lever 15 descends from a high position to a low position while moving along the main body rail section 23. The connection shaft 17 rises from the low position to the high position along the slide groove 21. The connection shaft 17 rises in a state in which the ratchet-structured gear 43 is not meshed with the ratchet teeth 57. Since the torque limiter 18*a* is mounted on the sliding section 18, the pull-out and pull-back of the sheet feed cassette 3 are performed at a low speed. The sheet lifting and lowering tray 25 also rotates upward, and the sheet layer presses the sheet feed roller 30. Since the pusher 32 also rises synchronously, by the operation of the detachment mechanism 20, the ratchet-structured gear 43 is meshed with the ratchet teeth 57.

As described above, in the present embodiment, the sliding section 18 is provided at the side opposite to the connection shaft 17 with respect to the shaft 16 of the tray depression lever 15. The main body rail section 23 is formed to have a long but gently curved inclination. Therefore, the load at the time of pulling out the sheet feed cassette 3 can be reduced.

If the sheet feed cassette 3 is pulled out, the sliding section 18 of the tray depression lever 15 slides on the main body rail section 23 to be pushed upward. The sheet lifting and lowering tray 25 is pushed downward by the connection shaft 17 at the opposite side. At that time, the one-way clutch 44 mounted on the connection shaft 17 of the sheet lifting and lowering tray 25 idles, thereby relieving limit by the detachment ratchet section 48. Therefore, the sheet lifting and lowering tray 25 can move smoothly downward along the slide groove 21.

Switching between engagement and disengagement between the ratchet-structured gear 43 and the ratchet teeth 57 at the time of lifting and lowering the sheet lifting and lowering tray 25 can be performed by the link mechanism of the detachment mechanism 20. Since the system control, the planetary gear and the gear train are not used as in the conventional embodiment, simple constitution and miniaturization can be realized, and the manufacturing cost can be reduced.

In the modification of the present embodiment, the same or similar part and component as those in the above-mentioned embodiment are donated with the same reference numerals and are described below.

In the above embodiment, the tray depression levers 15 are provided on both the side surfaces 12 of the sheet feed cassette 3, but it may be arranged at only one side.

The sheet lifting and lowering tray 25 is energized upward by the spring member 27 such as a coil spring. Instead of the spring member 27, a spindle, a motor, another elastic body, or the like may be used. The one-way clutch 44 is provided as an idle mechanism in the ratchet-structured gear 43. As an idle mechanism, an electromagnetic clutch, a ratchet claw, or the like may be used instead of the one-way clutch 44.

In the above-described embodiment, the sheet feed cassette 3, the detachment mechanism 20, and the pickup mechanism 4 provided in the image forming apparatus 1 are described. The present embodiment can be applied not only to the image forming apparatus 1 but also to an image processing apparatus. The image processing apparatus has two fixing sections including a fixing section for fixing and a fixing section for decoloring. The image processing apparatus can include image erasing as well as image formation.

According to at least one embodiment described above, by using the tray depression lever 15, the main body rail section 23 can be formed to have a long but gentle inclination. Therefore, it is possible to reduce the force at the time of pulling out the sheet feed cassette 3. The switching between the engagement and the disengagement of the ratchet-structured gear 43 and ratchet teeth 57 in switching the lifting and lowering of the sheet lifting and lowering tray 25 can be performed by the link mechanism of the detachment mechanism 20. Since the system control, the planetary gear and the gear train are not used as in the conventional embodiment, simple constitution and miniaturization can be realized, and the manufacturing cost can be reduced.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image processing apparatus, comprising:

a sheet feed cassette capable of being pulled out from an apparatus main body;

an operation lever, arranged at the side of the sheet feed cassette, configured to move rotationally around a shaft positioned at the middle of a length in a pull-out direction;

a sliding section arranged at the rear side in the pull-out direction with respect to the shaft in the operation lever;

a sheet lifting and lowering tray configured to hold a sheet and adjust an inclination thereof in conjunction with the operation lever;

a main body rail section, arranged in the apparatus main body, configured to guide running of the sliding section at the time of pulling out the sheet feed cassette;

a connection shaft supported by the sheet lifting and lowering tray is provided at the side opposite to the sliding section with respect to the shaft of the operation lever, and a ratchet-structured gear is arranged in the connection shaft;

a detachment mechanism having ratchet teeth capable of engaging and disengaging with the ratchet-structured gear is provided; and at the time of pulling out the sheet feed cassette, the ratchet-structured gear is meshed with the ratchet teeth.

2. The image processing apparatus according to claim 1, wherein the operation levers are arranged at both sides of the sheet feed cassette.

3. The image processing apparatus according to claim 1, wherein the sliding section rotatably slides along the main body rail section.

4. The image processing apparatus according to claim 1, wherein an idle mechanism is provided in the ratchet-structured gear provided in the connection shaft, and at the time of pulling out the sheet feed cassette, the ratchet-structured gear is moved while being idled by the idle mechanism.

5. The image processing apparatus according to claim 1, wherein the detachment mechanism includes a detachment ratchet section having the ratchet teeth, a detachment slider capable of advancing and retracting, and a detachment link for enabling the detachment ratchet section to be engaged with or disengaged from the ratchet teeth in conjunction with the detachment slider.

6. The image processing apparatus according to claim 5, wherein a pickup mechanism configured to pick up a sheet on the sheet lifting and lowering tray to the apparatus main body includes a sheet feed roller to press the sheet and a pusher section moving in synchronization with the sheet feed roller, and by pushing the detachment slider by the pusher section, the ratchet teeth of the detachment ratchet section are disengaged from the ratchet-structured gear.

7. The image processing apparatus according to claim 6, wherein the sheet feed cassette is pulled out from the apparatus main body to the pickup mechanism side.

8. The image processing apparatus according to claim 1, wherein the sheet feed cassette is suspended by the main body rail section at the sliding section to be supported at the time of pull-out.

* * * * *